US005528793A

United States Patent [19]

Schbot

[11] Patent Number: 5,528,793

[45] Date of Patent: Jun. 25, 1996

[54] MULTI-PURPOSE SQUEEGEE WITH DEFLECTOR

[76] Inventor: Michel Schbot, 4424 Elan Pl., Annandale, Va. 22003

[21] Appl. No.: 499,761

[22] Filed: Jul. 10, 1995

[51] Int. Cl.[6] ..... A47L 25/00

[52] U.S. Cl. ..... 15/245; 15/245.1; 15/244.1; 294/54.5; 37/266; 37/278

[58] Field of Search ..... 15/245, 245.1, 15/244.1, 244.2, 244.3, 244.4, 236.01, 236.05, 116.2, 117, 118, 121, 111; 294/54.5, 55, 57, 58, 59; 37/284, 285, 278, 265, 266

[56] References Cited

U.S. PATENT DOCUMENTS

| | | | |
|---|---|---|---|
| 323,730 | 8/1885 | Phillips | 37/266 |
| 1,144,891 | 6/1915 | Cannon | 15/245 |
| 1,839,285 | 1/1932 | Winkie | 294/54.5 |
| 2,587,382 | 2/1952 | Pyne | 15/245 |
| 2,895,237 | 7/1959 | Abrahams | 37/278 |
| 2,975,454 | 3/1961 | Bernstein | 15/244.2 |
| 3,002,213 | 10/1961 | Lindstrom | 15/244.1 |
| 3,091,790 | 6/1963 | Schroeder | 15/245 |
| 3,872,536 | 3/1975 | Siemund | 15/244.1 |
| 3,983,596 | 10/1976 | Siemund | 15/244.1 |
| 4,317,250 | 3/1982 | Shutts | 15/245 |
| 4,597,204 | 7/1986 | Heiden | 294/54.5 |
| 4,716,616 | 1/1988 | Poon | 15/245 |
| 5,117,530 | 6/1992 | Rank | 15/245 |
| 5,347,676 | 9/1994 | Saitoh | 15/245 |

FOREIGN PATENT DOCUMENTS

| | | | |
|---|---|---|---|
| 13219 | 2/1911 | France | 15/245 |
| 99733 | 6/1923 | Switzerland | 15/245 |
| 288402 | 4/1928 | United Kingdom | 15/245 |

*Primary Examiner*—Gary K. Graham

[57] ABSTRACT

A multipurpose squeegee intended for use in removing snow, slush, water and other liquids from automobile surfaces and various other surfaces. The squeegee comprises a downwardly open U-shaped base within which are secured two layers of polyethylene foam or similar material. The foam extends slightly beyond the ends of the base to prevent damage to adjacent surfaces. A handle is attached to the base. A generally Y-shaped deflector with the upper arms thereof formed as curved wings is attached to the upper surface of the base to deflect excess material in the direction that the squeegee is being moved.

2 Claims, 1 Drawing Sheet

MULTI-PURPOSE SQUEEGEE WITH DEFLECTOR

TECHNICAL FIELD OF THE INVENTION

The present invention relates to a squeegee for the removal of snow, slush and water from automobiles and various other surfaces.

DESCRIPTION OF THE PRIOR ART

There are numerous types of squeegee-type devices in use today. These devices are generally designed for removal of water and liquid from surfaces but often of little effectiveness in the removal of thicker coatings of materials such as snow or slush.

SUMMARY OF THE INVENTION

An object of the invention is to provide a squeegee type tool that can be used for a variety of purposes and designed to remove thick coatings of snow, slush, and other materials.

A further object of the present invention is to overcome the shortcomings of various types of squeegee devices currently in use.

Other objects and advantages will become apparent from the drawings and description which follow.

DETAILED DESCRIPTION OF THE INVENTION

Figure 1:
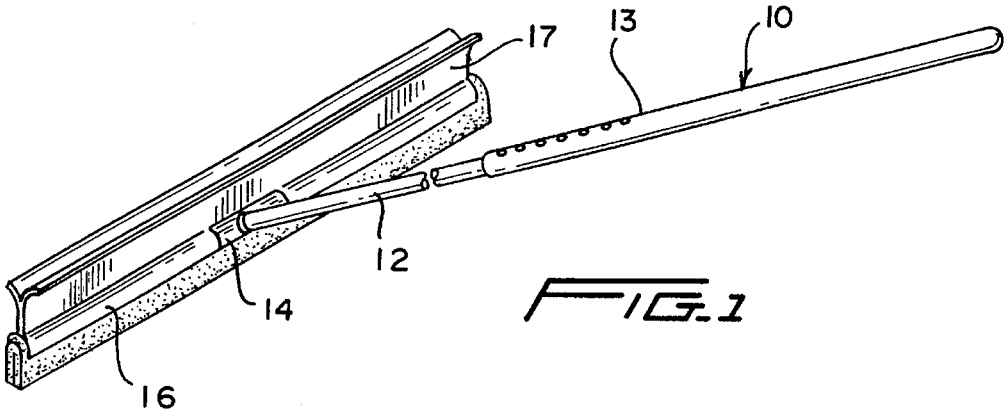
FIG. 1 is a perspective view showing a preferred embodiment of the invention.
Figure 2:
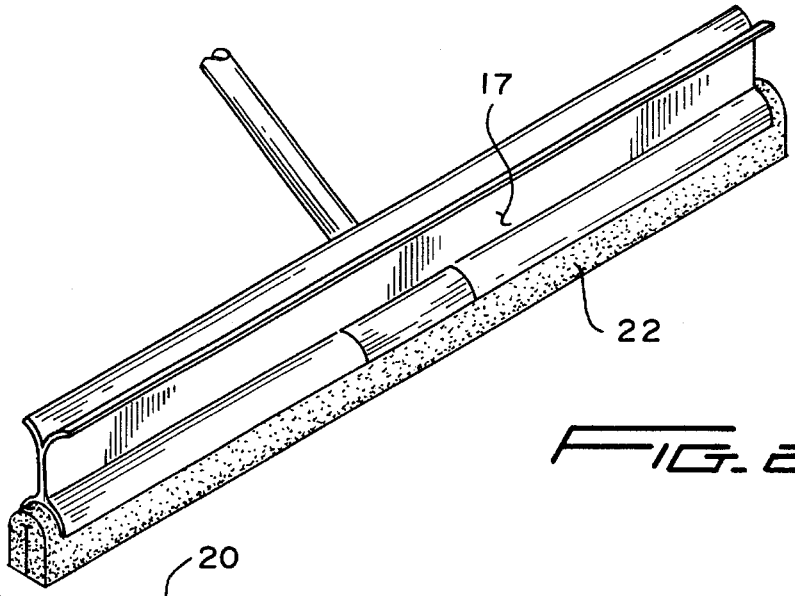
FIG. 2 is an enlarged perspective view of the lower end of the multipurpose squeegee.
Figure 3:
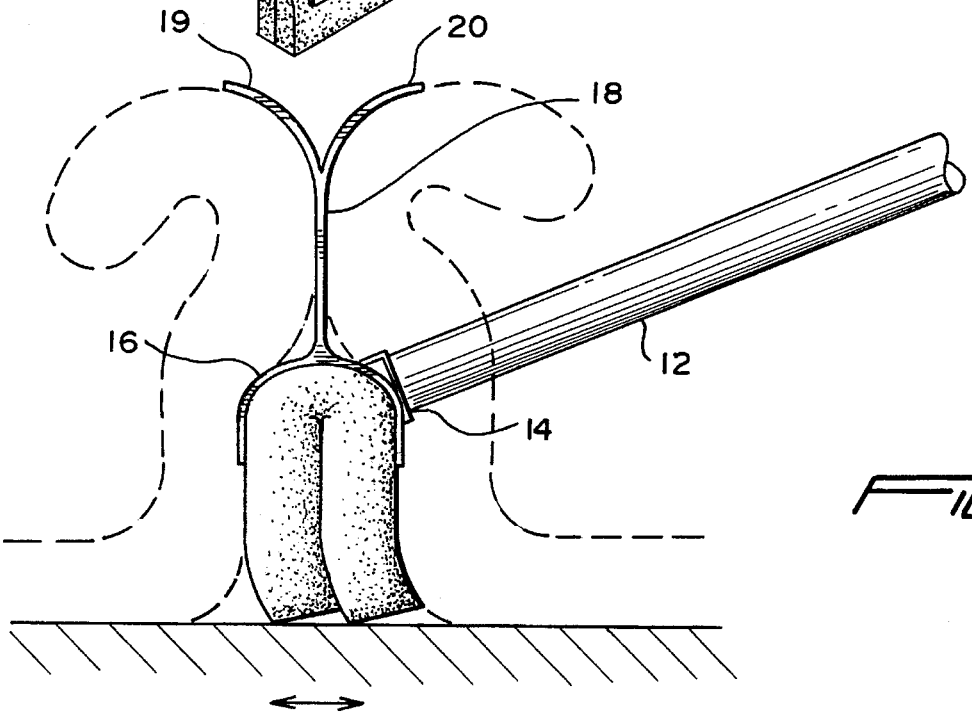
FIG. 3 is an end view of the multipurpose squeegee with particular focus on the Y-shaped deflector.

The multipurpose squeegee includes an adjustable length handle 10 having a lower section 12 mounted within an upper handle section 13. The lower section 12 is secured to a bracket 14 rigidly attached to the downwardly open U-shaped base 16. Attached to base 16 is the lower end of stem 18 of deflector 17. The upper end of deflector 17 includes oppositely curved wings 19, 20 each designed to deflect material removed in the direction that the squeegee is being moved.

The U-shaped base 16 has a section of polyethylene foam or like material 22 secured therein by any appropriate means. Foam material extends slightly beyond each end of the U-shaped base.

In use the squeegee is either drawn toward or pushed away from the user. Material removed by the blade rather than building up along the blade or simply riding over the top of the U-shaped base follows upwardly along the lower leg of the Y-shaped member and is then projected in the direction of movement along the smooth surface of either wing 19 or 20. In this way the squeegee is able to remove larger quantities of material from the surface.

Having described my invention I now claim:

1. A multipurpose squeegee for removing snow, slush and liquid from surfaces comprising: a generally U-shaped, downwardly open base member, said base member being elongated defining opposite ends, said base member having foam material secured therein, a handle secured to said U-shaped base member, a generally Y-shaped deflector comprising a stem having a lower end and an upper end, said lower end secured to the U-shaped base member and the upper end being bifurcated to form upper arms of the Y-shaped deflector, said arms being oppositely curved to project material removed from a surface in a direction of movement of the squeegee.

2. The multipurpose squeegee of claim 1 wherein the foam material extends outwardly slightly beyond the ends of the U-shaped base member.

* * * * *